US011229890B2

(12) United States Patent
Takanezawa et al.

(10) Patent No.: US 11,229,890 B2
(45) Date of Patent: Jan. 25, 2022

(54) AGITATING MECHANISM AND METHOD FOR MANUFACTURING AGITATING MECHANISM

(71) Applicant: TOYOTA JIDOSHA KABUSHIKI KAISHA, Toyota (JP)

(72) Inventors: Yu Takanezawa, Nissin (JP); Hiroyuki Ikuta, Nissin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 469 days.

(21) Appl. No.: 16/185,190

(22) Filed: Nov. 9, 2018

(65) Prior Publication Data

US 2019/0176109 A1 Jun. 13, 2019

(30) Foreign Application Priority Data

Dec. 13, 2017 (JP) ..... JP2017-238707

(51) Int. Cl.

| | |
|---|---|
| ***B01F 7/00*** | (2006.01) |
| ***B01F 7/14*** | (2006.01) |
| ***F28D 1/04*** | (2006.01) |
| ***B01F 15/00*** | (2006.01) |
| *F28F 13/12* | (2006.01) |

(52) U.S. Cl.

CPC ..... *B01F 7/145* (2013.01); *B01F 7/00908* (2013.01); *B01F 7/00916* (2013.01); *B01F 7/14* (2013.01); *B01F 15/00922* (2013.01); *F28D 1/04* (2013.01); *F28F 13/12* (2013.01)

(58) Field of Classification Search

None

See application file for complete search history.

(56) References Cited

U.S. PATENT DOCUMENTS

| | | | | |
|---|---|---|---|---|
| 3,559,956 | A | 2/1971 | Gray | |
| 4,416,543 | A * | 11/1983 | Brinkmann | B29C 48/38 366/80 |
| 4,615,664 | A * | 10/1986 | Kolossow | B29C 44/3442 425/4 C |
| 2011/0030929 | A1* | 2/2011 | Powell | F02M 31/20 165/121 |

FOREIGN PATENT DOCUMENTS

| | | | |
|---|---|---|---|
| CN | 201389362 | Y | 1/2010 |
| CN | 203018028 | U | 6/2013 |
| JP | 5-52293 | U | 7/1993 |
| JP | 2006-097493 | A | 4/2006 |
| JP | 2011038510 | A | 2/2011 |

OTHER PUBLICATIONS

The First Office Action dated Feb. 3, 2021 from the China National Intellectual Property Administration in CN Application No. 201811511397.5.

* cited by examiner

*Primary Examiner* — Anshu Bhatia
(74) *Attorney, Agent, or Firm* — Sughrue Mion, PLLC

(57) ABSTRACT

A size of an agitating mechanism can be reduced. An agitating mechanism according to an aspect of the present disclosure is an agitating mechanism for agitating fluid flowing through inside a pipe, including: a rotary body placed inside the pipe so as to be able to rotate in a circumferential direction of an inner circumferential surface of the pipe; and a regulation part configured to regulate a movement of the rotary body in a longitudinal direction of the pipe. The rotary body includes a hollow part penetrating the pipe in the longitudinal direction of the pipe and an agitating blade provided in the hollow part.

5 Claims, 11 Drawing Sheets

AGITATING MECHANISM AND METHOD FOR MANUFACTURING AGITATING MECHANISM

CROSS REFERENCE TO RELATED APPLICATIONS

This application is based upon and claims the benefit of priority from Japanese patent application No. 2017-238707, filed on Dec. 13, 2017, the disclosure of which is incorporated herein in its entirety by reference.

BACKGROUND

The present disclosure relates to an agitating mechanism and a method for manufacturing an agitating mechanism; for example, an agitating mechanism capable of agitating fluid flowing through a pipe, and a method for manufacturing such an agitating mechanism.

Japanese Unexamined Patent Application Publication No. 2006-97493 discloses an agitating mechanism in which an agitating blade is rotated without using a rotating shaft in order to agitate fluid flowing through a pipe. Specifically, the agitating mechanism disclosed in Japanese Unexamined Patent Application Publication No. 2006-97493 includes a rotary blade whose body is fixed inside a tubular body. Further, one end of the rotary blade is connected to a supply pipe with a bearing interposed therebetween and the other end of the rotary blade is connected to a discharge pipe with a bearing interposed therebetween. The above-described rotary blade is rotated by a driving source and agitates fluid flowing through a tubular body by using the blade body.

SUMMARY

The applicant has found the following problem. In the agitating mechanism disclosed in Japanese Unexamined Patent Application Publication No. 2006-97493, the rotary blade is connected to the supply pipe or the discharge pipe with the bearing interposed therebetween. The agitating mechanism disclosed in Japanese Unexamined Patent Application Publication No. 2006-97493 therefore has a problem that a mechanism for rotating a rotary blade becomes larger.

The present disclosure has been made in view of the above-described problem and achieves miniaturization of an agitating mechanism.

A first exemplary aspect is an agitating mechanism for agitating fluid flowing through a pipe, including:

a rotary body placed inside the pipe so as to be able to rotate in a circumferential direction of an inner circumferential surface of the pipe; and a regulation part configured to regulate a movement of the rotary body in a longitudinal direction of the pipe, in which the rotary body includes a hollow part penetrating the pipe in the longitudinal direction of the pipe and an agitating blade provided in the hollow part.

In the above-described agitating mechanism, the rotary body is disposed inside the pipe so as to be able to rotate. Therefore, a complicated mechanism, such as the agitating mechanism disclosed in Japanese Unexamined Patent Application Publication No. 2006-97493, is not required. For the above reason, the size of the agitating mechanism can be reduced.

In the above-described agitating mechanism, it is preferable that the rotary body includes a cylindrical body and the agitating blade disposed in a hollow part of the cylindrical body, and an outer edge of the cylindrical body is inserted, as the regulation part, into a recess continuously formed in the circumferential direction of the inner circumferential surface of the pipe.

The above-described agitating mechanism preferably includes, as the rotary body, a planetary gear wheel configured to be engaged with an internal tooth part continuously formed in the circumferential direction of the inner circumferential surface of the pipe, and a sun gear wheel configured to be engaged with the planetary gear wheel, and the sun gear wheel preferably includes the hollow part penetrating therethrough in a thickness direction and the agitating blade provided in the hollow part.

In the above-described agitating mechanism, it is preferable that a tooth of each of the internal tooth part, the planetary gear wheel, and the sun gear wheel is a helical tooth, and an engaging part between the internal tooth part and the planetary gear wheel, and an engaging part between the planetary gear wheel and the sun gear wheel serve as the regulation part.

In the above-described agitating mechanism, it is preferable that a recess is continuously formed in the circumferential direction of the inner circumferential surface of the pipe, the internal tooth part is formed on the bottom of the recess, the planetary gear wheel is placed inside the recess, and in a place where the planetary gear wheel is engaged with the sun gear wheel, a tip of the sun gear wheel is placed closer to an outer circumferential surface of the pipe than an inner circumferential surface of a region of the pipe adjacent to a region of the pipe where the recess is formed is, and a side surface of the recess serves as the regulation part.

In the above-described agitating mechanism, it is preferable that the planetary gear wheel includes the hollow part penetrating therethrough in the thickness direction and the agitating blade provided in the hollow part.

In a method for manufacturing an agitating mechanism according to another aspect of the present disclosure, the agitating mechanism described above is formed by using a lamination forming method.

According to the present disclosure, the size of the agitating mechanism can be reduced.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied are explained hereinafter in detail with reference to the drawings. However, the present disclosure is not limited to the embodiments shown below. Further, for clarifying the explanation, the following descriptions and the drawings are simplified as appropriate.

First Embodiment

Figure 1:
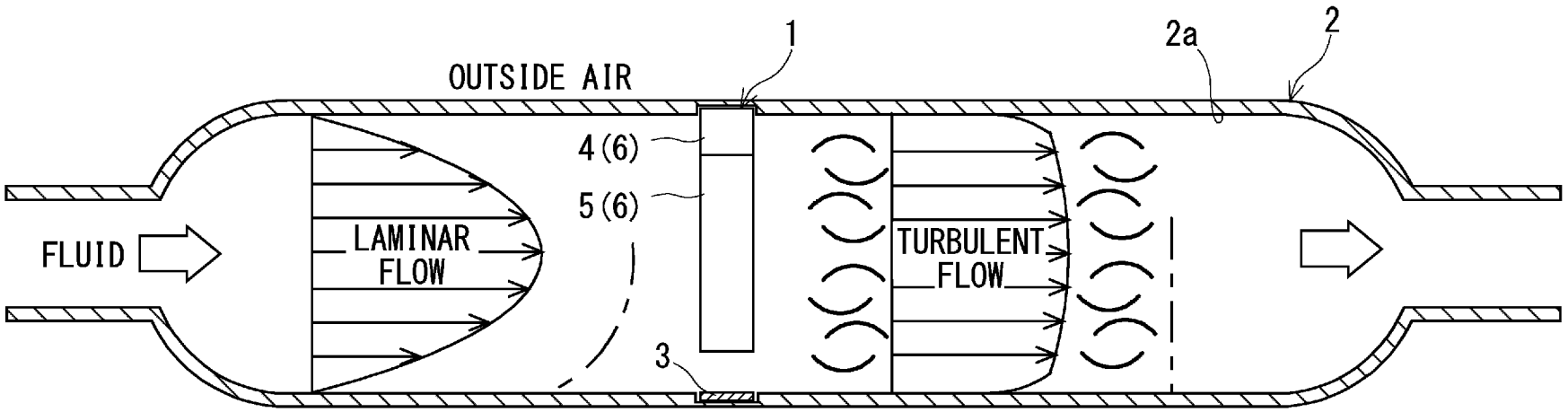
FIG. 1 is a partial cross-sectional view schematically showing a pipe provided with an agitating mechanism according to a first embodiment.
Figure 2:
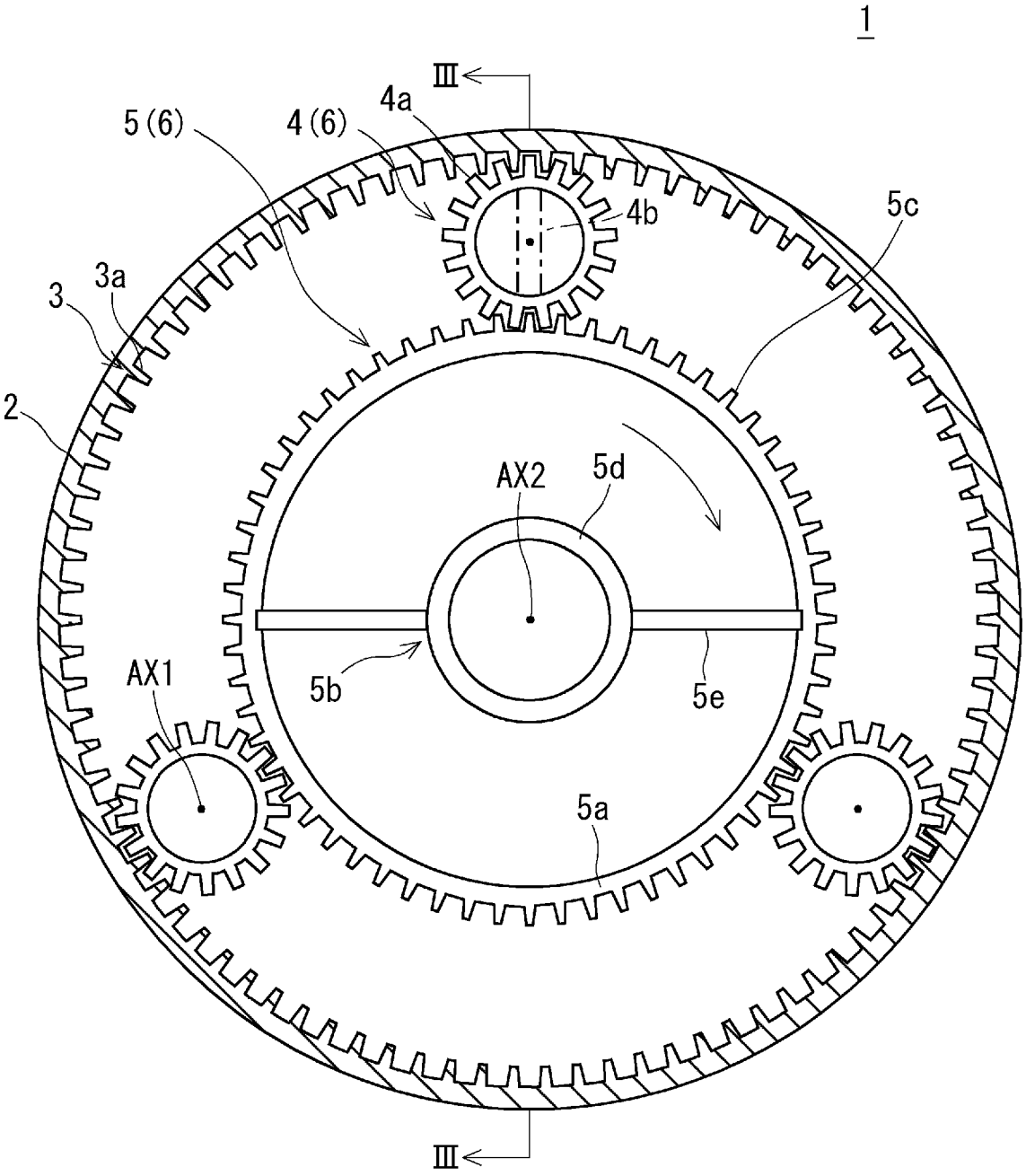
FIG. 2 is a drawing in which an agitating mechanism according to a first embodiment is seen from the longitudinal direction of a pipe.
Figure 3:
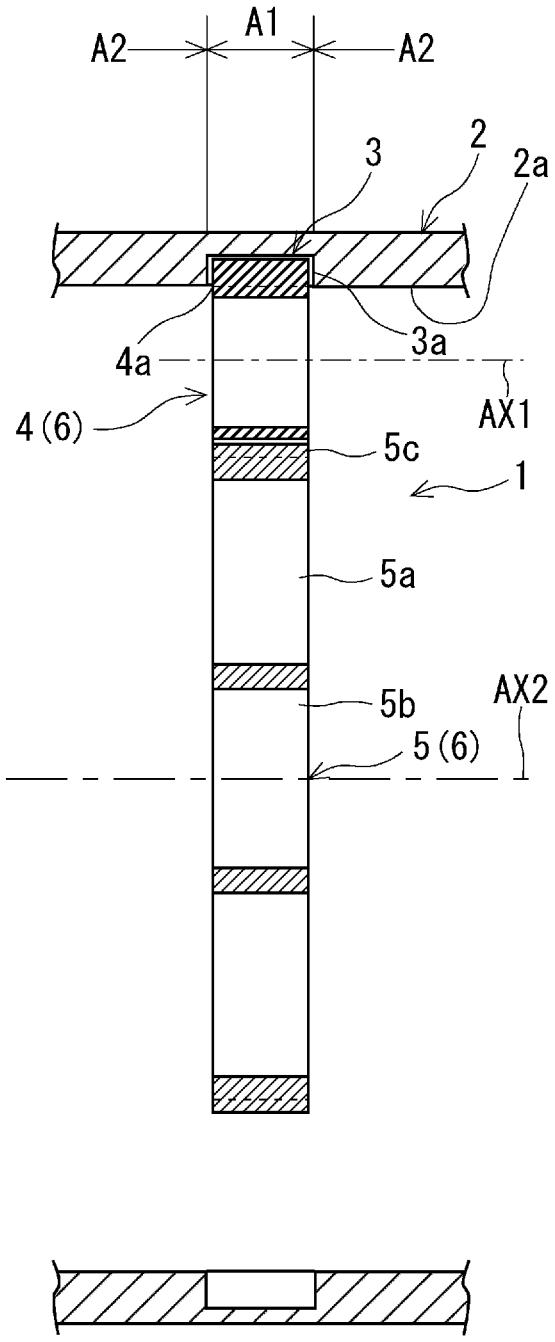
FIG. 3 is a III-III cross-sectional view of FIG. 2.

First, a structure of an agitating mechanism according to this embodiment will be described. FIG. 1 is a partial cross-sectional view schematically showing a pipe provided with an agitating mechanism according to this embodiment. FIG. 2 is a drawing in which an agitating mechanism according to this embodiment is seen from the longitudinal direction of a pipe. FIG. 3 is a III-III cross-sectional view of FIG. 2. Note that for clarifying the drawings, a simplified agitating mechanism is shown in FIG. 1, etc.

An agitating mechanism 1 according to this embodiment, for example, is disposed in a pipe 2 connected to a heat exchanger such as a radiator as shown in FIG. 1 and used for cooling fluid circulating through the pipe 2. Note that an inner circumferential surface 2*a* of the pipe 2 is formed as a circular peripheral surface. Further, the fluid may be either gas or liquid.

The agitating mechanism 1 includes an internal tooth part 3, planetary gear wheels 4 and a sun gear wheel 5 as shown in FIGS. 2 and 3. The internal tooth part 3 includes a plurality of helical teeth 3*a* formed on the inner circumferential surface 2*a* of the pipe 2, and they are continuously disposed in the circumferential direction of the inner circumferential surface 2*a* of the pipe 2. That is, a plurality of the helical teeth 3*a* are arranged at a predetermined pitch in the circumferential direction of the inner circumferential surface 2*a* of the pipe 2.

The planetary gear wheels 4 are disposed inside the pipe 2 and have a rotation axis AX1 which is roughly parallel to the longitudinal direction of the pipe 2 as shown in FIGS. 2 and 3. Further, the planetary gear wheels 4 basically have a cylindrical shape having a thickness which is roughly equal to the length of the internal tooth part 3 in a longitudinal direction of the pipe 2, and include a hollow part penetrating therethrough in a direction in which the rotation axis AX1 extends.

Helical teeth 4*a* corresponding to the helical teeth 3*a* of the internal tooth part 3 are formed on an outer circumferential surface of the planetary gear wheels 4. Further, the helical teeth 4*a* are engaged with the helical teeth 3*a* of the internal tooth part 3. For example, three or more of the above-described planetary gear wheels 4 are disposed at intervals in the circumferential direction of the inner circumferential surface 2*a* of the pipe 2. For example, as shown in FIG. 2, three planetary gear wheels 4 are disposed at intervals of roughly 120° in the circumferential direction of the inner circumferential surface 2*a* of the pipe 2.

The sun gear wheel 5 is disposed inside the pipe 2 as shown in FIGS. 2 and 3. Further, the sun gear wheel 5 has a rotation axis AX2 which is roughly parallel to the rotation axis AX1 of the planetary gear wheel 4 and, for example, the rotation axis AX2 passes through roughly the center of the inner circumferential surface of the pipe 2.

The sun gear wheel 5 and the planetary gear 4 constitute a rotary body 6 and the sun gear wheel 5 includes a gear wheel body 5*a* and an agitating blade 5*b*. The gear body 5*a* basically has a cylindrical shape having a thickness which is roughly equal to that of the planetary gear wheel 4, and includes a hollow part penetrating therethrough in a direction in which the rotation axis AX2 extends. Further, helical teeth 5*c* corresponding to the helical teeth 4*a* of the planetary gear wheels 4 are formed on an outer circumferential surface of the gear wheel body 5*a*. Further, the helical teeth 5*c* are engaged with the helical teeth 4*a* of the planetary gear wheel 4.

Figure 4:
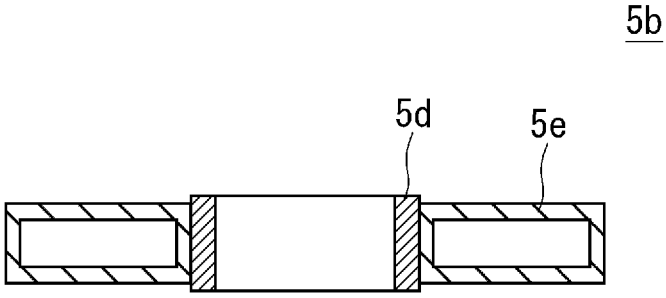
FIG. 4 is a cross-sectional view of an agitating blade according to a first embodiment.

The agitating blade 5*b* is disposed in a hollow part of the gear wheel body 5*a* and includes a cylindrical body 5*d* and a blade 5*e*. Note that FIG. 4 is a cross-sectional view of the agitating blade according to this embodiment. The cylindrical body 5*d*, as shown in FIGS. 2 and 4, is disposed roughly at the center of the hollow part of the gear wheel body 5*a* and includes a hollow part penetrating therethrough in a direction in which the rotation axis AX2 of the sun gear wheel 5 extends.

The blades 5*e* are disposed at intervals in a circumferential direction of the cylindrical body 5*d*. Further, one end of the blade 5*e* is fixed to an outer circumferential surface of the cylindrical body 5*d* and the other end of the blade 5*e* is fixed to an inner circumferential surface of the gear wheel body 5*a*. Specifically, for example, each of the blades 5*e* is a roughly rectangular-shaped ring body, and they are disposed at intervals of about 180° in the circumferential direction of the cylindrical body 5*d* as shown in FIG. 4. Further, the blade 5*e* is disposed roughly in parallel with the rotation axis AX2 of the sun gear wheel 5.

In the above-described agitating mechanism 1, when fluid flowing through the pipe 2 comes into contact with the blade 5*e* and hence the agitating blade 5*b* starts to rotate, the planetary gear 4 revolves while rotating on its own axis, so that the sun gear wheel 5 rotates. As a result, while the agitating blade 5*b* rotates and fluid flowing through a hollow part of the sun wheel gear 5 is agitated, fluid flowing between the internal tooth part 3 and the sun gear wheel 5 is agitated by the planetary gear wheels 4.

In the above-described agitating mechanism 1, the rotary body 6 is disposed inside the pipe 2 so as to be able to rotate. Therefore, a complicated mechanism, such as the agitating mechanism disclosed in Japanese Unexamined Patent Application Publication No. 2006-97493, is not required. For the above reason, the size of the agitating mechanism 1 according to this embodiment can be reduced as compared with that of Japanese Unexamined Patent Application Publication No. 2006-97493.

Note that, for example, when a temperature of outside air is lower than that of fluid flowing through the pipe 2, a flow of the fluid before it passes through the agitating mechanism 1 is laminar as shown in FIG. 1. Further, a temperature distribution of fluid in a radial direction of the pipe 2 is as follows: the temperature is high in the center of the pipe 2 and is low near the inner circumferential surface of the pipe 2. Note that in FIG. 1, the temperature distribution of the fluid is indicated by an alternate long and short dash line, and the longitudinal direction of the pipe 2 indicates the temperature of the fluid and the radial direction of the pipe 2 indicates a position of the fluid.

On the other hand, it is possible to make a flow of the fluid after it passes through the agitating mechanism 1 turbulent since the flow is agitated by the agitating mechanism 1 as described above. As a result, the temperature distribution of the fluid in the radial direction of the pipe 2 can be made roughly uniform. Thus, the temperature of the fluid near the inner circumferential surface of the pipe 2 can be made higher as compared with a case where a flow of fluid is laminar, and hence a heat exchange with outside air can be performed efficiently. For the above reason, the agitating mechanism 1 according to this embodiment can improve cooling efficiency of fluid.

Further, while the helical teeth 3*a* of the internal tooth part 3 and the helical teeth 4*a* of the planetary gear 4 are engaged with each other, the helical teeth 4*a* of the planetary gear wheel 4 and the helical teeth 5*c* of the sun gear 5 are engaged with each other. Therefore, a movement of the planetary gear wheel 4 and the sun gear wheel 5 (i.e., a movement of the rotary body 6) in the longitudinal direction of the pipe 2 can be regulated. That is, the engaging part between the helical tooth part 3 and the planetary gear wheel 4, and the engaging part of the planetary gear wheel 4 and the sun gear wheel 5 serve as a regulation part for regulating the movement of the rotary body 6 in the longitudinal direction of the pipe 2.

Note that as shown in FIG. 3, a bottom of each of the helical teeth 3*a* may be disposed at a position closer to an outer circumferential surface of the pipe 2 than the inner circumferential surface 2*a* of a region A2 adjacent to a region A1 of the pipe 2 where the internal tooth part 3 is formed is. Further, in a place where the helical teeth 3*a* and the helical teeth 4*a* are engaged with each other, a tip of each of the helical teeth 4*a* is preferably placed closer to the outer circumferential surface of the pipe 2 than the inner circumferential surface 2*a* of the region A2 of the pipe 2 is. That is, at least in a place farthest from the center of the pipe 2, a tip of the helical teeth 4*a* is preferably placed closer to the outer circumferential surface of the pipe 2 than the inner circumferential surface 2*a* of the region A2 of the pipe 2 is. As a result, when the planetary gear wheel 4 is about to move in the longitudinal direction of the pipe 2, it comes into contact with a side surface of a recess formed between the helical teeth 3*a* of the internal tooth part 3 in the pipe 2. For the above reason, a movement of the planetary gear wheel 4 in the longitudinal direction of the pipe 2 can be regulated reliably.

Next, a method for manufacturing the agitating mechanism 1 according to this embodiment will be described. The agitating mechanism 1 described above is formed by using a lamination forming method. With this method, the agitating mechanism 1 can be easily formed. Note that in addition to the region A1 of the pipe 2 where the agitating mechanism 1 is provided, a part of the region A2 may be formed by using the lamination forming method. As a result, it is possible to provide the agitating mechanism 1 not only on a straight part of the pipe 2 but also immediately in front of or behind a bending part of the pipe 2.

Note that in the case where the above-described agitating mechanism 1 is provided in the pipe 2 by welding means or the like, in order to place an internal tooth gear with helical teeth formed on its inner circumferential surface in the pipe 2, it is necessary to sever the pipe 2 into two pieces, place the internal tooth gear wheel in which the planetary gear wheel 4 and the sun gear wheel 5 are engaged with each other between these pieces of the pipe 2, and then weld together these pieces of the pipe 2 with the internal tooth gear wheel. However, there is a possibility that a step (or a gap) might be formed between the pipe 2 and the internal tooth gear wheel when the welding is performed. Further, it is difficult to provide the agitating mechanism immediately in front of or behind the bending part of the pipe 2.

Further, there is a possibility that accuracy of an engagement of the internal tooth gear wheel and the planetary gear wheel 4 might be decreased because of heat generated by welding together the pipe 2 with the internal tooth gear wheel.

Further, it is necessary to secure a releasing part for releasing heat and forces that are generated when the pipe 2 is welded in front of or behind a welding part, and hence a size of a cooling mechanism becomes larger.

Further, when the pipe 2 is welded, there is a possibility that beads or the like might project from the inner circumferential surface 2*a* of the pipe 2. These projections not only deteriorate cooling performance but also make removal of the beads or the like very difficult.

In contrast, since the agitating mechanism 1 according to this embodiment is formed by using the lamination forming method as described above, the above-described problem which occurs in the case when the agitating mechanism 1 is formed by welding etc. does not occur.

In this embodiment, three planetary gear wheels 4 are disposed at intervals of about 120° in the circumferential direction of the inner circumferential surface 2*a* of the pipe 2. However, positions and the number of the planetary gear wheels 4 are not limited and may be any arbitrary positions and number as long as the position of the rotating sun gear 5 can be maintained.

Although the planetary gear wheel 4 described above does not include an agitating blade, a hollow part of the planetary gear wheel 4 may include an agitating blade 4*b*. Therefore, fluid flowing through the pipe 2 can be agitated more reliably.

In the above-described embodiment, a movement of the rotary body 6 in the longitudinal direction of the pipe 2 is regulated by using helical teeth. However, for example, the movement of the rotary body 6 in the longitudinal direction of the pipe 2 may be regulated by arranging a group of planar teeth (e.g., spur teeth) having different pitches in the longitudinal direction of the pipe 2.

Second Embodiment

Figure 5:
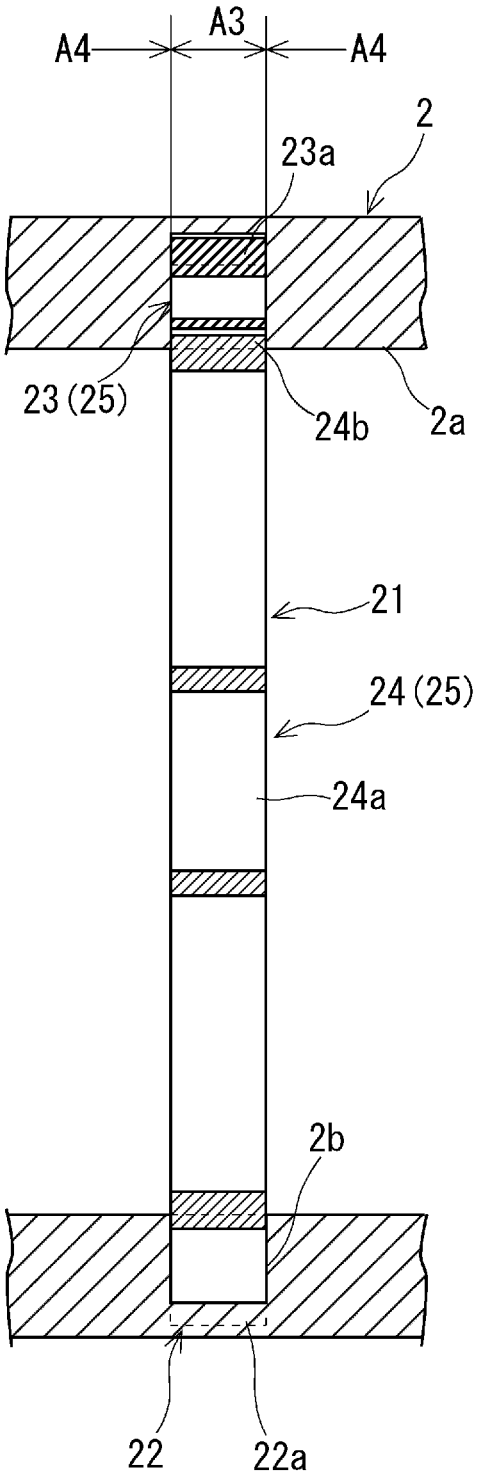
FIG. 5 is a cross-sectional view of an agitating mechanism according to a second embodiment.

The agitating mechanism 1 according to the first embodiment has a structure using helical teeth. However, the agitating mechanism 1 can have a structure having planar teeth (e.g., spur teeth). FIG. 5 is a cross-sectional view of an agitating mechanism according to this embodiment, which corresponds to FIG. 3.

An agitating mechanism 21 has a structure which is roughly the same as that of the agitating mechanism 1 of the first embodiment, and includes an internal tooth part 22, a planetary gear wheel 23 and a sun gear wheel 24 as shown in FIG. 5. Note that a recess 2*b* is continuously formed on the inner circumferential surface 2*a* of the pipe 2 in the circumferential direction of the inner circumferential surface 2*a*.

An internal tooth part 22 is formed on the bottom of the recess 2*b* of the pipe 2 and includes a plurality of planar teeth 22*a* disposed at a predetermined pitch in the circumferential direction of the internal circumferential surface 2*a* of the pipe 2. That is, the planar teeth 22*a* roughly extend in the longitudinal direction of the pipe 2.

The planetary gear wheel 23 is disposed inside the recess 2*b* of the pipe 2. Spur teeth 23*a* corresponding to the planar teeth 22*a* of the internal tooth part 22 are formed on an outer circumferential surface of the planetary gear wheel 23. Further, the planar teeth 23*a* are engaged with the planar teeth 22*a* of the internal tooth part 22. Note that a bottom of each of the planar teeth 23*a* is disposed at a position closer to an outer circumferential surface of the pipe 2 than the inner circumferential surface 2*a* of a region A4 adjacent to a region A3 of the pipe 2 where the agitating mechanism 21 is provided is. That is, at least the bottom of the planar teeth 23*a* (i.e., a part between neighboring planar teeth 23*a*) disposed closest to the center of the pipe 2 is dented so that the bottom is closer to the outer circumferential surface of the pipe 2 than the inner circumferential surface 2*a* of the region A4 of the pipe 2 is.

The sun gear wheel 24 and the planetary gear wheel 23 constitute a rotary body 25, and the sun gear wheel 24 includes an agitating blade 24*a* having the same structure as that of the agitating blade 5*b* according to the first embodiment has. Further, planar teeth 24*b* corresponding to the planar teeth 23*a* of the planetary gear wheel 23 are formed on an outer circumferential surface of the sun gear wheel 24. Further, the planar teeth 24*b* are engaged with the planar teeth 23*a* of the planetary gear wheel 23. Note that in a place where the planetary gear wheel 23 and the sun gear wheel 24 are engaged with each other, a tip of the sun gear wheel 24 is placed closer to the outer circumferential surface of the pipe 2 than the inner circumferential surface 2*a* of the region A4 of the pipe 2 is. That is, the tip of at least the planar teeth 24*b* that is placed closest to the engaged planetary gear wheel 23 projects beyond the inner circumferential surface 2*a* of the region A4 of the pipe 2 toward the outer circumferential surface of the pipe 2.

With such a structure, when the planetary gear wheel 23 is about to move in the longitudinal direction of the pipe 2, it comes into contact with a side surface of the recess 2*b* of the pipe 2. Further, when the sun gear wheel 24 is about to move in the longitudinal direction of the pipe 2, the planer teeth 24*b* of the sun gear wheel 24 come into contact with a side surface of the recess 2*b* of the pipe 2. For the above reasons, a movement of the planetary gear wheel 23 and the sun gear wheel 24 (i.e., a movement of the rotary body 25) in the longitudinal direction of the pipe 2 can be regulated. That is, a side surface of the recess 2*b* serves as a regulation part for regulating the movement of the rotary body 25 in the longitudinal direction of the pipe 2.

Third Embodiment

Figure 6:
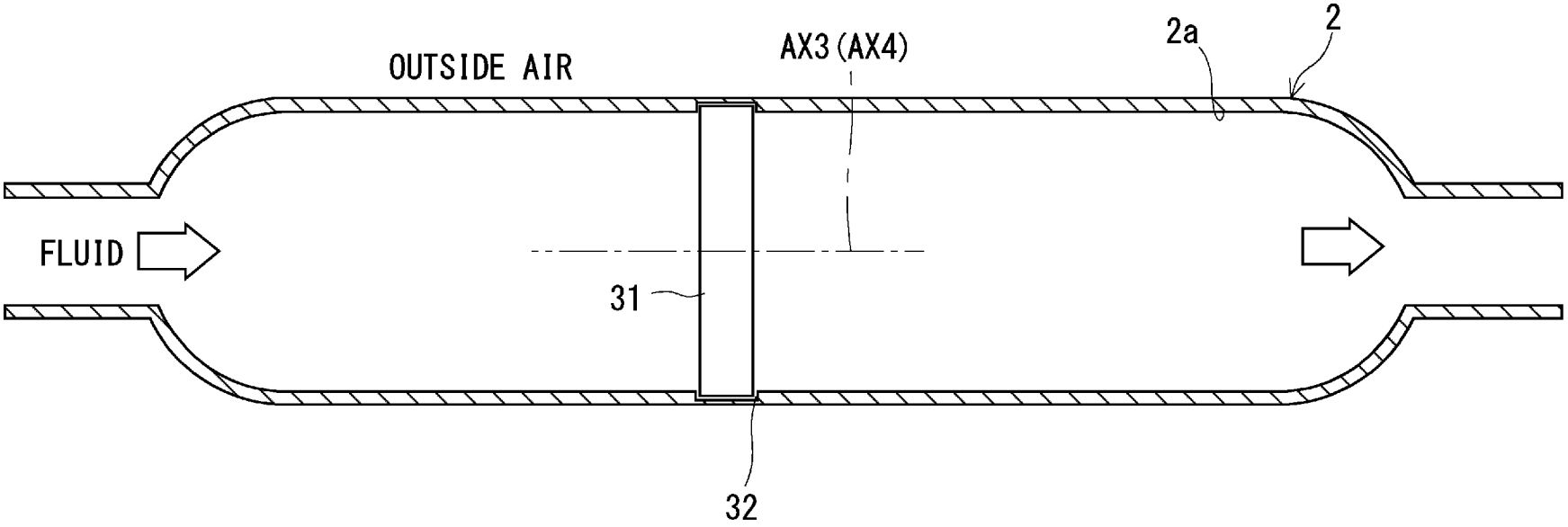
FIG. 6 is a partial cross-sectional view schematically showing a pipe provided with an agitating mechanism according to a third embodiment.
Figure 7:
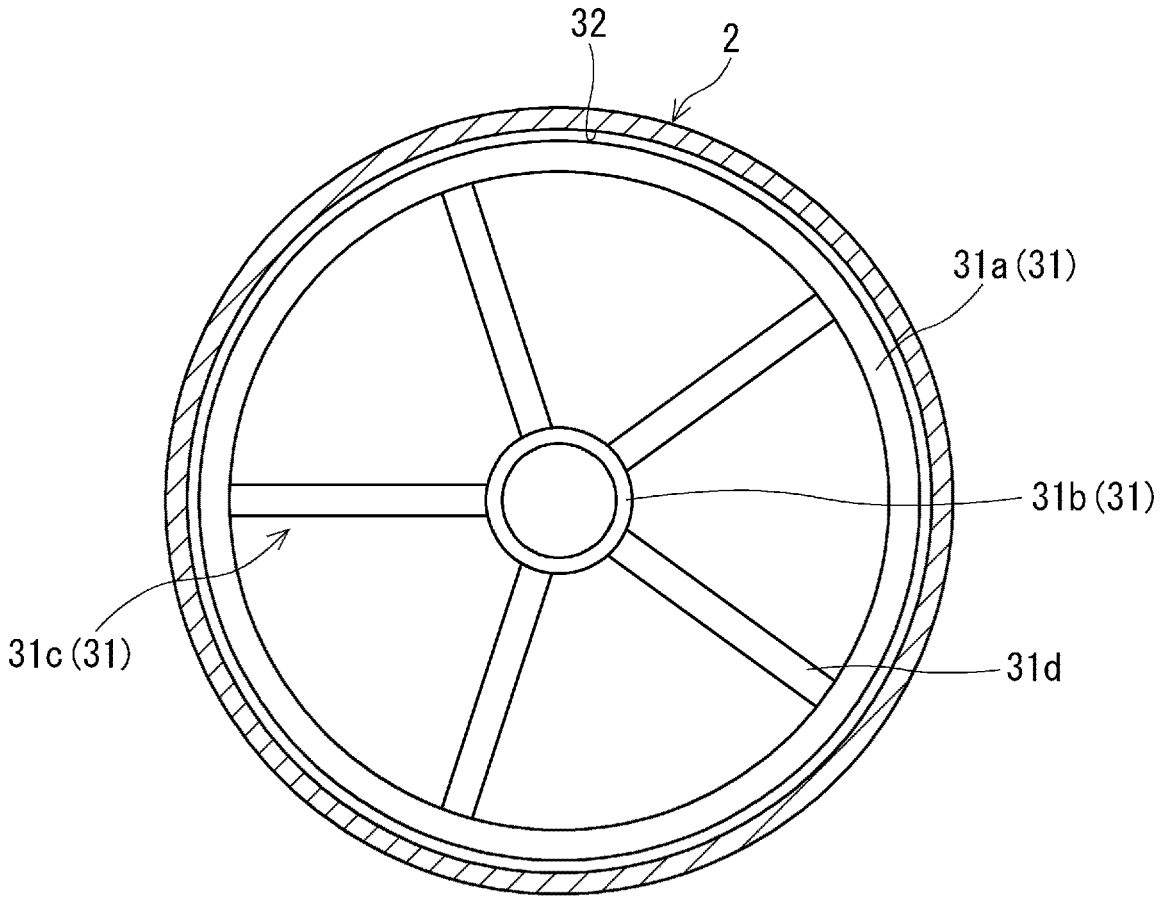
FIG. 7 is a drawing in which an agitating mechanism according to a third embodiment is seen from the longitudinal direction of a pipe.

In the first and second embodiments, planetary gear wheels and a sun gear wheel constitute a rotary body. However, the agitating mechanism can be configured without using a gear wheel mechanism. FIG. 6 is a partial cross-sectional view schematically showing a pipe provided with an agitating mechanism according to this embodiment. FIG. 7 is a drawing in which an agitating mechanism according to this embodiment is seen from the longitudinal direction of a pipe.

As shown in FIGS. 6 and 7, a rotary body 31 according to this embodiment includes a first cylindrical body 31*a*, a second cylindrical body 31*b* and an agitating blade 31*c*, and is disposed inside the pipe 2. The first cylindrical body 31*a* has a rotation axis AX3 which is roughly parallel to the longitudinal direction of the pipe 2. Further, the first cylindrical body 31*a* includes a hollow part penetrating therethrough in a direction in which the rotation axis AX3 extends. That is, the first cylindrical body 31*a* is disposed so as to extend in the longitudinal direction of the pipe 2. Note that the first cylindrical body 31*a* may include teeth formed on an outer circumferential surface of the first cylindrical body 31*a*. However, it is preferable that the first cylindrical body 31*a* include no teeth so that the rotary body 31 can rotate smoothly.

The second cylindrical body 31*b* has a small outside diameter with respect to an inner diameter of the first cylindrical body 31*a*, and has a thickness which is roughly equal to that of the first cylindrical body 31*a* (i.e., the length in the longitudinal direction of the pipe 2). The above-referenced second cylindrical body 31*b* is disposed inside the first cylindrical body 31*a*, and roughly speaking, the rotation axis AX4 of the second cylindrical body 31*b* is disposed on the rotation axis AX3 of the first cylindrical body 31*a*. Further, the second cylindrical body 31*b* includes a hollow part penetrating therethrough in a direction in which the rotation axis AX4 extends. That is, the second cylindrical body 31*b* is disposed so as to extend in the longitudinal direction of the pipe 2.

The agitating blade 31*c* includes a plurality of blades 31*d*. The plurality of blades 31*d* connect an outer circumferential surface of the second cylindrical body 31*b* and an inner circumferential surface of the first cylindrical body 31*a*, and the blades 31*b* are arranged roughly in a radial configuration around the rotation axis AX4.

A movement of the above-described rotary body 31 in the longitudinal direction of the pipe 2 is regulated by a regulation part 32. The regulation part 32 is a recess (hereinafter, this recess is denoted by the same reference number 32) continuously formed in a circumferential direction of the inner circumferential surface 2*a* of the pipe 2. The recess 32 has a diameter roughly equal to that of an outside diameter of the first cylindrical body 31*a*, and has a width roughly equal to a thickness of the first cylindrical body 31*a*. Further, an outer edge of the first cylindrical body 31*a* is inserted into the recess 32.

In the above-described agitating mechanism, the rotary body 31 is disposed inside the pipe 2 so as to be able to rotate. Therefore, a complicated mechanism, such as the agitating mechanism disclosed in Japanese Unexamined Patent Application Publication No. 2006-97493, is not required. The size of the agitating mechanism 1 therefore can be reduced.

Further, when the rotary body 31 is about to move in the longitudinal direction of the pipe 2, a side surface of the rotary body 31 comes into contact with that of the recess 32. For the above reason, a movement of the rotary body 31 in the longitudinal direction of the pipe 2 can be regulated satisfactorily.

Note that the present disclosure is not limited to the above described embodiments and various modifications can be made without departing from the spirit of the present disclosure.

Figure 8:
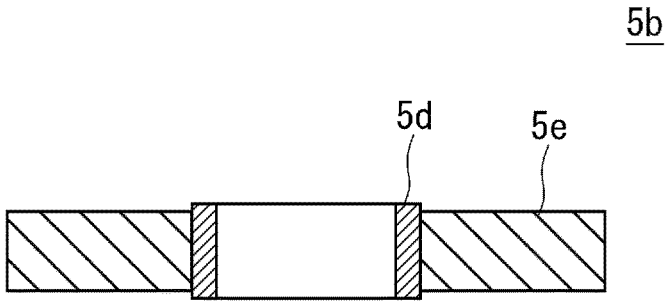
FIG. 8 shows a different agitating blade.
Figure 9A:
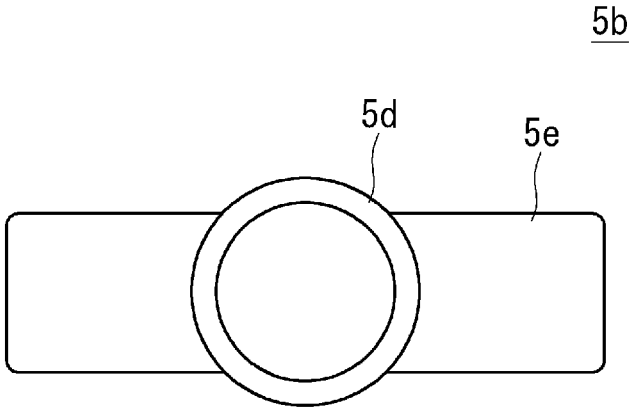
FIG. 9A shows a different agitating blade.
Figure 9B:
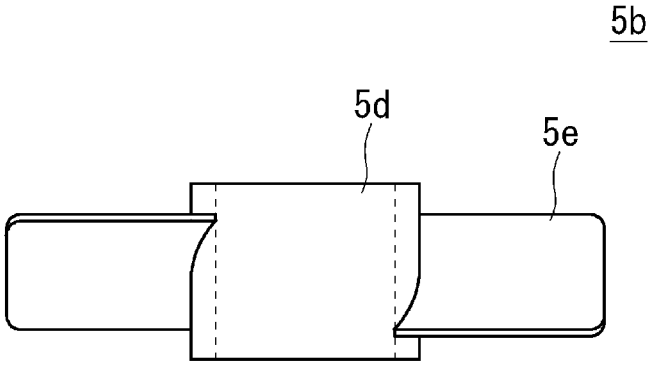
FIG. 9B shows a different agitating blade.
Figure 10A:
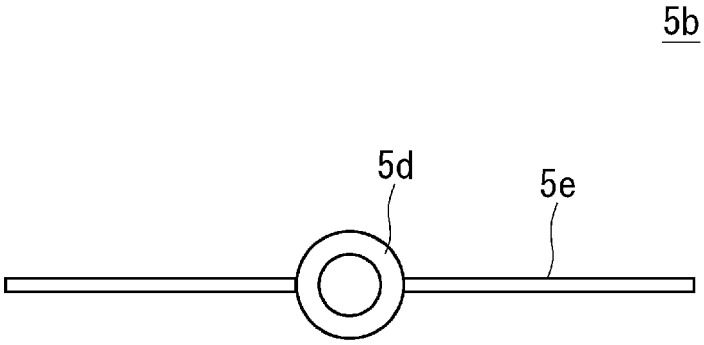
FIG. 10A shows a different agitating blade.
Figure 10B:
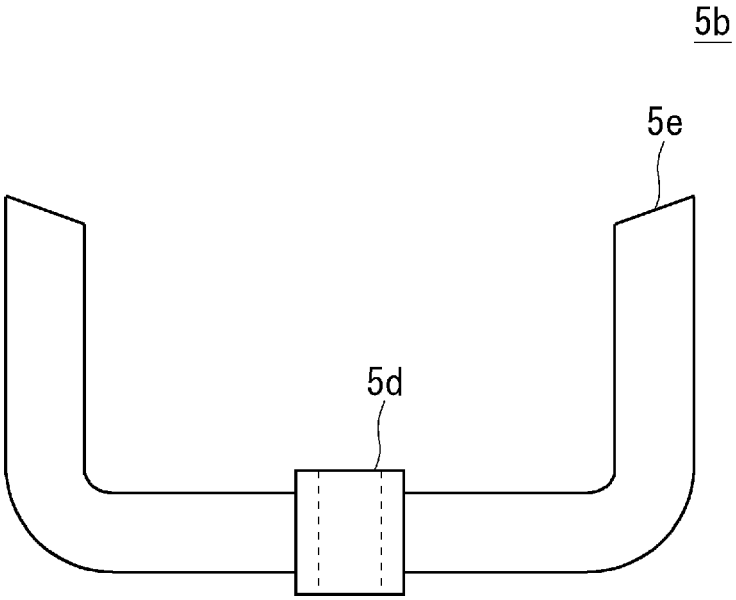
FIG. 10B shows a different agitating blade.
Figure 11A:
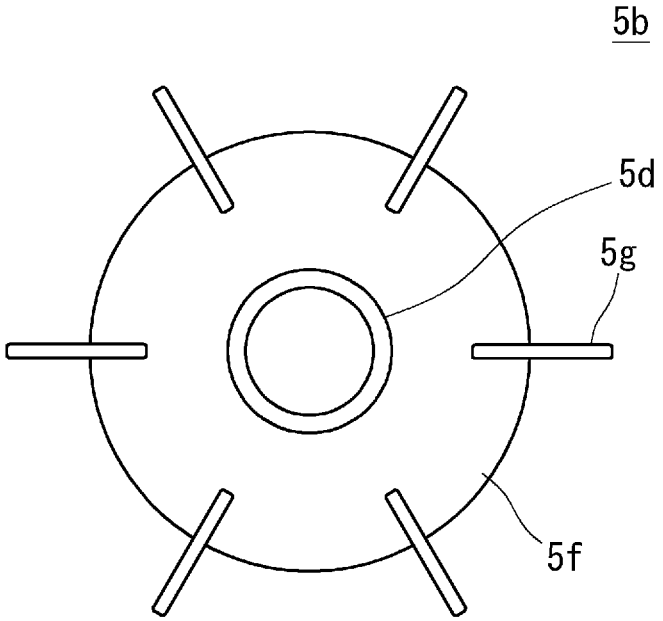
FIG. 11A shows a different agitating blade.
Figure 11B:
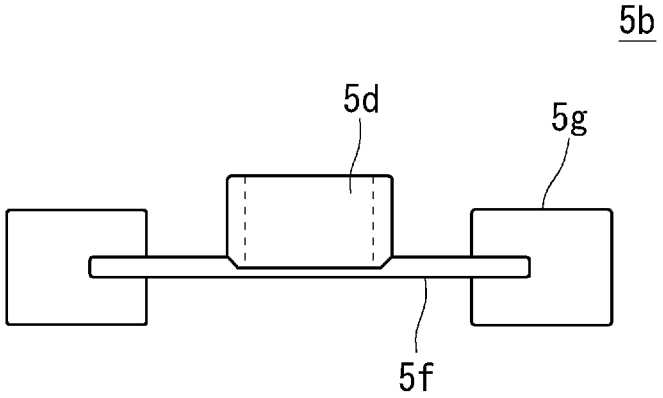
FIG. 11B shows a different agitating blade.
Figure 12A:
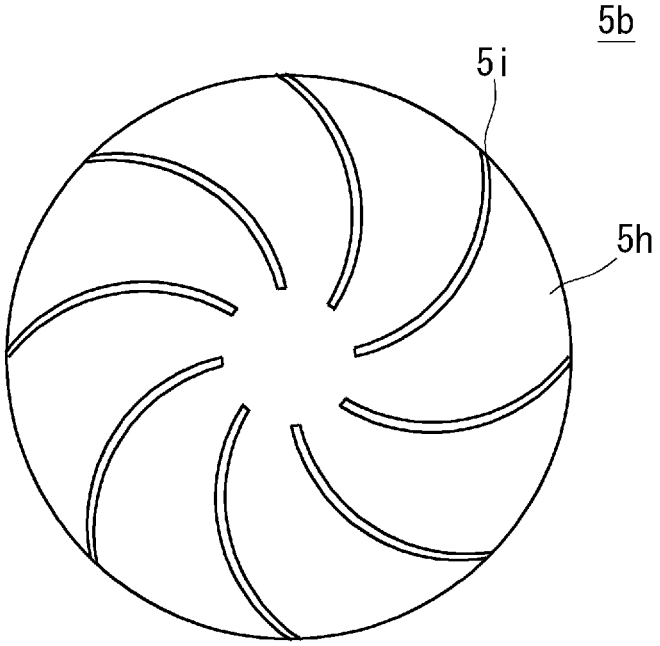
FIG. 12A shows a different agitating blade.
Figure 12B:
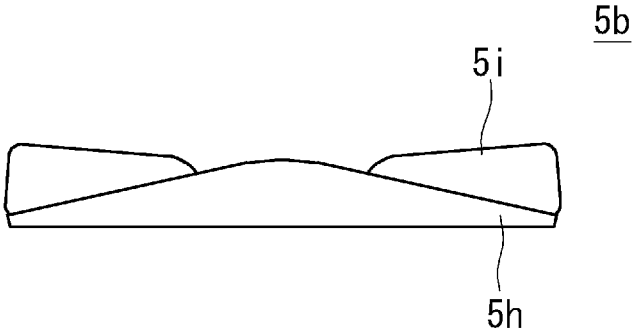
FIG. 12B shows a different agitating blade.

For example, the blade 5*e* of the agitating blade 5*b* according to the first embodiment is a roughly rectangular-shaped ring body. However, as shown in FIG. 8, the blade 5*e* may be a roughly rectangular-shaped plate body. Further, the blade 5*e* may be inclined as shown in FIGS. 9A and 9B or may be bent as shown in FIGS. 10A and 10B. Further, as shown in FIGS. 11A and 11B, the agitating blade 5*b* may be a so-called flat turbine type in which blades 5*g* are fixed on an outer edge of a circular plate body 5*f* to which a cylindrical body 5*d* is fixed inside thereof. Further, as shown in FIGS. 12A and 12B, the agitating mechanism 5*b* may be a so-called spiral umbrella type in which a plurality of spiral shaped blades 5*i* are fixed on a convex surface of an umbrella-shaped plate body 5*h*. In this case, for example, an outer edge of the plate body 5*h* of the agitating blade 5*b* is fixed on the inner circumferential surface of the gear wheel body 5*a*. In brief, the agitating blade 5*b* may have any arbitrary shape capable of agitating fluid flowing through the pipe 2. That is, there are no particular restrictions on positions, shapes, the number and the like of blades. Note that in each of FIGS. 9A to 12A shows a drawing in which the agitating blade 5*b* is seen from the longitudinal direction of the pipe 2 and each of FIGS. 9B to 12B shows a plan view of the agitating blade 5*b*. However, in FIG. 11B and FIG. 12B, some of the blades are omitted to clarify a shape of the agitating blade 5*b*.

For example, a regulation part may have any structure as long as a movement of a rotary body in the longitudinal direction of the pipe 2 can be regulated. For example, the planetary gear wheel 4 and the sun gear wheel 5 according to the first embodiment may constitute a rotary body and a part of the planetary gear wheel 4 may be inserted into the recess 32 of the pipe 2 according to the third embodiment.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. An agitating mechanism for agitating fluid flowing through a pipe, comprising:

a pipe; and a rotary body placed inside the pipe so as to be able to rotate in a circumferential direction of an inner circumferential surface of the pipe; wherein one of the pipe and the rotary body is configured to regulate a movement of the rotary body in a longitudinal direction of the pipe, wherein the rotary body comprises a hollow part penetrating the pipe in the longitudinal direction of the pipe and an agitating blade provided in the hollow part, a planetary gear wheel configured to be engaged with an internal tooth part continuously formed in the circumferential direction of the inner circumferential surface of the pipe, and a sun gear wheel configured to be engaged with the planetary gear wheel, wherein the sun gear wheel comprises the hollow part penetrating therethrough in a thickness direction and the agitating blade provided in the hollow part.

2. The agitating mechanism according to claim 1, wherein the rotary body comprises a cylindrical body and the agitating blade disposed in a hollow part of the cylindrical body, and an outer edge of the cylindrical body is inserted, as a regulation part, into a recess continuously formed in the circumferential direction of the inner circumferential surface of the pipe.

3. The agitating mechanism according to claim 1, wherein a tooth of each of the internal tooth part, the planetary gear wheel, and the sun gear wheel is a helical tooth, and an engaging part between the internal tooth part and the planetary gear wheel, and an engaging part between the planetary gear wheel and the sun gear wheel serve as a regulation part.

4. The agitating mechanism according to claim 1, wherein a recess is continuously formed in the circumferential direction of the inner circumferential surface of the pipe, the internal tooth part is formed on the bottom of the recess, the planetary gear wheel is placed inside the recess, and in a place where the planetary gear wheel is engaged with the sun gear wheel, a tip of the sun gear wheel is placed closer to an outer circumferential surface of the pipe than an inner circumferential surface of a region of the pipe adjacent to a region of the pipe where the recess is formed is, and a side surface of the recess serves as a regulation part.

5. The agitating mechanism according to claim 1, wherein the planetary gear wheel includes the hollow part penetrating therethrough in the thickness direction and the agitating blade provided in the hollow part.

* * * * *